United States Patent [19]

Noguchi et al.

[11] 3,976,023

[45] Aug. 24, 1976

[54] APPARATUS FOR MANEUVERING A SHIP

[75] Inventors: Tadamasa Noguchi, Kawasaki; Masao Matsuura, Agee; Senzou Ehata, Tokyo, all of Japan

[73] Assignee: Niigata Engineering Co., Ltd., Tokyo, Japan

[22] Filed: Jan. 29, 1975

[21] Appl. No.: 545,076

[52] U.S. Cl. ..... 114/144 E; 74/471 XY; 74/504; 115/18 E

[51] Int. Cl.[2] ..... B63H 25/24

[58] Field of Search ..... 74/471 R, 471 XY, 491, 74/504; 114/144 R, 144 E; 115/37, 18 E; 137/636.2; 180/6.48, 6.5; 192/.098; 200/6 A; 244/83 R, 83 B, 83 E; 318/588

[56] References Cited

UNITED STATES PATENTS

| | | | |
|---|---|---|---|
| 3,111,105 | 11/1963 | Bentkowsky et al. | 114/144 E |
| 3,323,607 | 6/1967 | Futamata | 74/471 XY |
| 3,350,956 | 11/1967 | Monge | 244/83 R X |
| 3,561,280 | 2/1971 | MacPhee | 244/83 R X |
| 3,662,243 | 5/1972 | Cavil et al. | 318/588 |
| 3,865,063 | 2/1975 | Norton | 114/144 E |
| 3,870,986 | 3/1975 | Oka et al. | 74/471 XY |

*Primary Examiner*—Stephen G. Kunin
*Attorney, Agent, or Firm*—Sughrue, Rothwell, Mion, Zinn & Macpeak

[57] ABSTRACT

A remote-control maneuvering apparatus for a ship having two sets of Z type propelling apparatus, comprising a maneuvering handle adapted to be inclined at any angle about a predetermined point and to be moved in its longitudinal direction, ahead and astern, switching transmitting apparatus adapted to issue signals for switching going ahead and astern in accordance with the travel distance of the handle in one of two components the sum of which constituting the angle of inclination of said handle, steering transmitting apparatus adapted to issue signals for steering the ship to port or starboard side in accordance with the travel distance of the handle in another component, and speed and clutch engaging and disengaging transmitting apparatus adapted to issue signals for controlling the speed of the engines as well as engaging and disengaging the clutch in accordance with the movement of said handle in the longitudinal direction thereof.

5 Claims, 7 Drawing Figures

FIG. 3
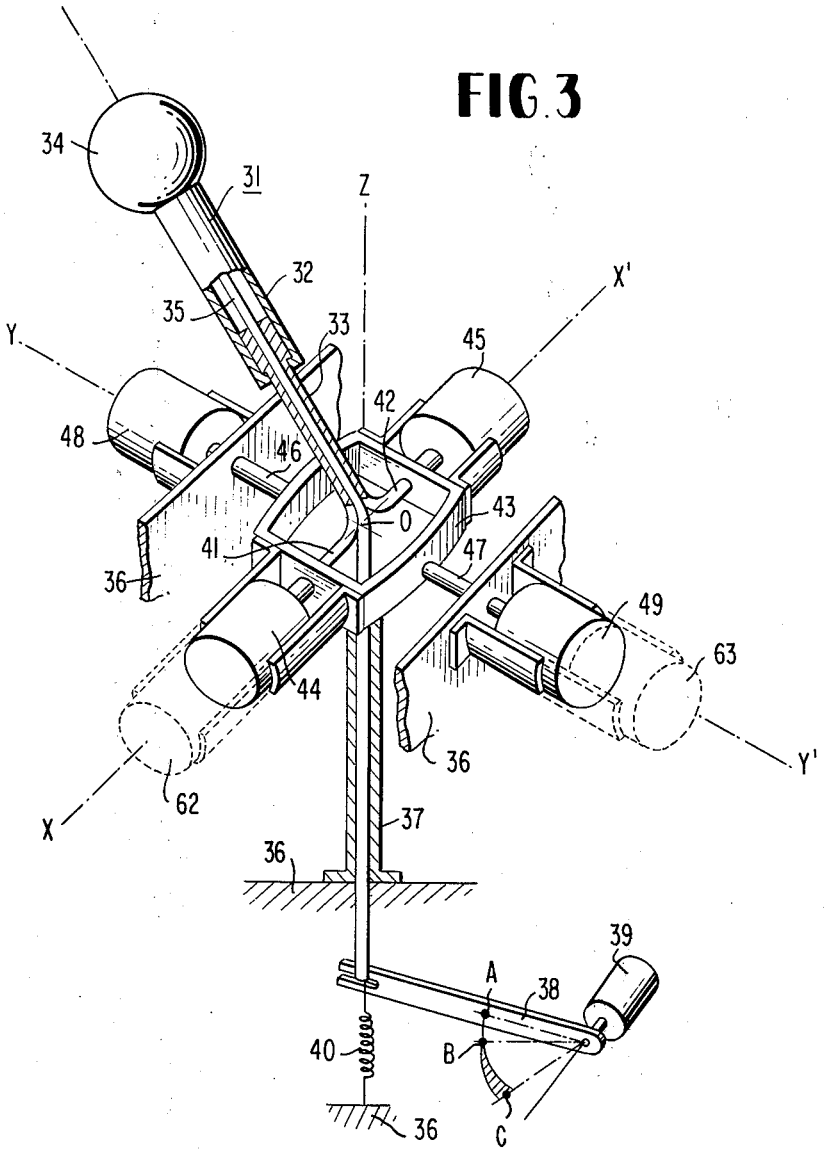
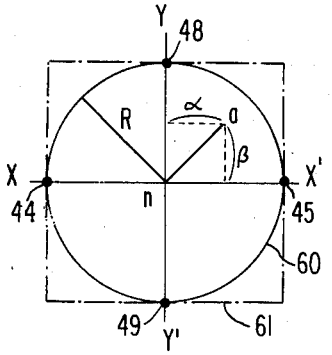
FIG. 5

APPARATUS FOR MANEUVERING A SHIP

BACKGROUND OF THE INVENTION

1. Field of the Invention

The present invention relates to an apparatus for maneuvering a ship, and more particularly to an apparatus which makes it possible to effect, in a ship having two sets or Z type propelling means, the control of the direction of the trailing flow of the propeller, the control of the revolution speed of the engine and the engaging and disengaging of clutch which are for providing steering as well as changing of going ahead and astern, by a single handle provided in the control stand or the bridge of the ship.

2. Description of the Prior Art

Hitherto, three to five kinds of handles or levers have been used for maneuvering ships having two sets of Z type propelling means, which handles or levers requiring complicated handling as could be done only by skilled engineer.

Although some attempts have been made to provide maneuvering of the ship by one handle, the motion of the handle thereof has been of one or two dimensions, each dimension defining one kind of control, so that additional handles or buttons have been required to provide special manner of maneuvering, for example dead-slow going or transversing. Therefore, these attempts have not been accepted successfully.

SUMMARY OF THE INVENTION

It is therefore an object of the present invention to overcome aforementioned shortcomings by providing an improved apparatus which can make it possible to effect all necessary patterns of ship-maneuvering by handling only one handle. More specifically, the present invention is aiming at providing an apparatus for maneuvering a ship, the apparatus having one handle and a transmitter interlocked therewith, said transmitter being adapted to issue electrical signals in accordance with the movement of the handle for effecting various controls solely or in combination, thereby all necessary patterns of ship maneuvering can be controlled by only one handle.

BRIEF EXPLANATION OF THE DRAWINGS

FIG. 3 is a perspective view of an embodiment of a handle in accordance with the present invention.

FIG. 5 is an illustration for explaining the manner in which the handle is maneuvered.

DETAILED DESCRIPTION OF THE INVENTION

Figure 1:
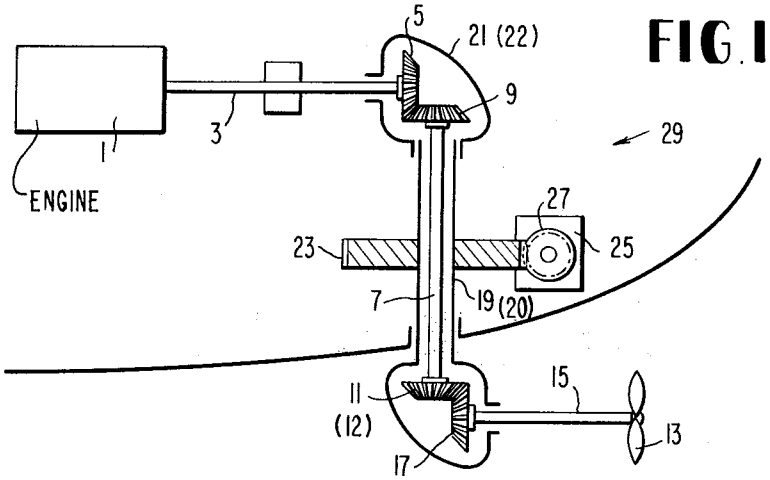
FIG. 1 is a front elevation of a Z type propelling means.
Figure 2:
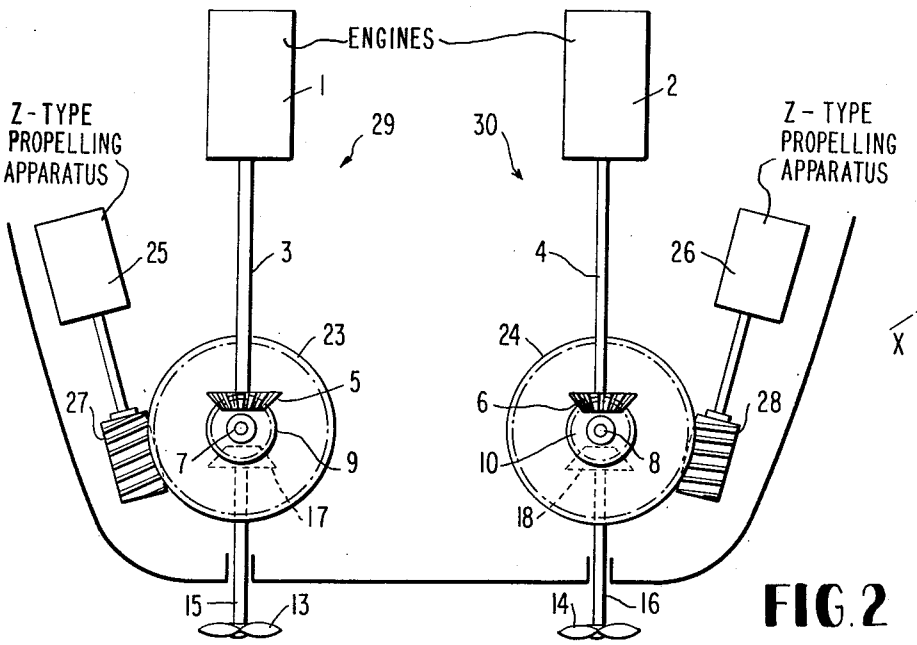
FIG. 2 is a plan view of two sets of Z propelling means.

Referring at first to FIGS. 1 and 2, reference numerals 1, 2 designate two engines respectively, shafts 3, 4 to which are secured level gears 5, 6 in engagement with level gears, 9, 10 which are provided at the top of intermediate shafts 7, 8. The intermediate shafts 7, 8 carry at their lowermost ends level gears 11, 12 which engages level gears 17, 18 of the shafts 15, 16 of the propellers 13, 14, respectively. The intermediate shafts 7, 8 and level gears 9, 10 and 11, 12 are covered by respective covers 19, 20, while upper level gears 5, 6 and 9, 10 are covered by another pair of covers 21, 22. At the middle portion of the covers 19, 20, there are provided warm wheels 23, 24, through which the direction or orientation of the propeller 13, 14 can be changed through 360° about the shafts 7, 8, by respective means 25, 26 for changing direction of propeller. The above described apparatus is known and is so called Z type propelling apparatus.

Referring to FIG. 3, an embodiment of the present invention is illustrated, which comprises a maneuvering handle 31 having a sleeve portion 32 engaging a control rod 33 slidably and rotatably.

The grip portion 34 of the handle 31 is connected to a wire 35 which goes through sleeve portion 32, the control rod 33, and a supporting rod 37 to be connected to the end of a supporting arm 38. The root portion of the supporting arm 38 is connected to a transmitter 39 for issuing speed controlling and clutch engaging and disengaging signals. Between the supporting arm 38 and the frame 36, is a coil spring 40, such that when the supporting arm is between position A where the grip 34 is pulled, its uppermost position and position B where the grip 34 is depressed to a certain position, the engine runs at its minimum speed, and at the position B, the clutch begins to meet. The further depression of the grip 34 provides the faster revolution speed of the engine which reaches its maximum when the supporting arm 38 comes to its lowermost position C.

The lower end of said control rod 33 is bent at right angle Z and provides leftwardly and rightwardly extending arms 41, 42 which constitute an axis X—X′ and which penetrate two sides of a quadrilateral frame 43 and are connected to ahead and astern changing transmitters 44, 45 which are secured to both sides of the frame 43. The another pair of side of the frame 43 fixedly carry arms 46, 47 which are at right angles with respect to the arms 41, 42 to constitute an axis Y—Y′. The arms 46, 47 penetrate the frame 36, 36 and are connected to steering transmitters 48, 49 for port sides and engine speed control transmitters 62, 63 for starboard side, which are secured to the frame 36, 36. A switch 64 (FIG. 6) is provided for selecting alternative one of the steering transmitters 48, 49 and the engine speed control transmitters. The handle 31 can be freely swing over desired angles, about an axis OZ.

Figure 4:
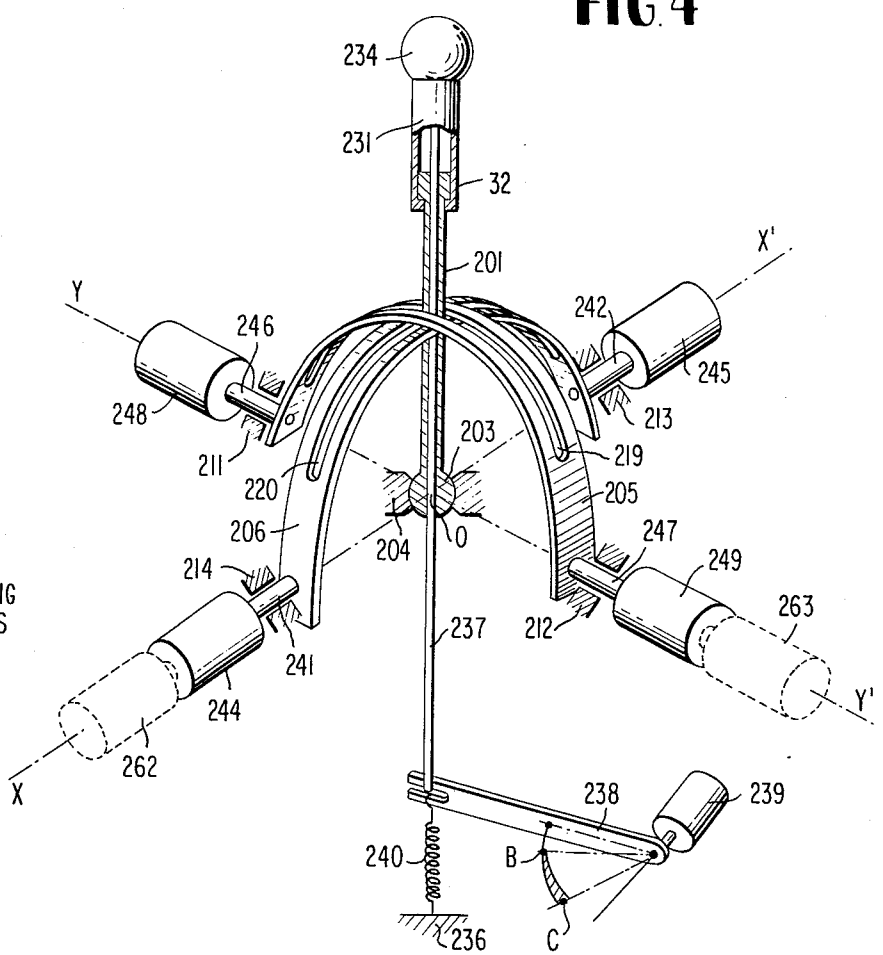
FIG. 4 is a perspective view of another embodiment of the handle in accordance with the present invention.

Another embodiment of the handle according to the invention is shown in FIG. 4. The handle of this embodiment can be operated in the same manner as the first mentioned handle. In this embodiment, semi-circular driving bodies 205, 206 are used in place of the quadrilateral frame. At the ends of the driving bodies 205, 206, driving shafts 241, 242, 246, 247 are secured rotatably through the bearings 211, 212, 213 and 214.

The shafts 241, 242, 246, 247 are connected to transmitters as used in the first embodiment.

The semi-circular driving bodies have respective elongated slots 219, 220, the crossing point of the slots is passed by a handle 201 which has at its uppermost end a grip 234 and a bulb portion 203 at its lower end. The bulb portion 203 is supported by bearing 204 and can be tilted in any direction and angle.

The arrangement is such that the direction and the amount of the inclination of the handle 201 is divided into an X—X component and a Y—Y component and is delivered to respective semi-circular driving bodies 205, 206.

Thus, the direction of inclination of the handle 201 is converted to the direction of rotation of the driving bodies 205, 206, and the angle of inclination of the handle is converted to the angles through which the driving bodies are rotated. Accordingly, respective transmitters 244, 245, 248, 249 issue respective signals in accordance with the inclination direction and inclination angle of the handle 201. The speed and the clutch engaging and disengaging transmitter 239 is operated in the same manner as the first embodiment.

Figure 6:
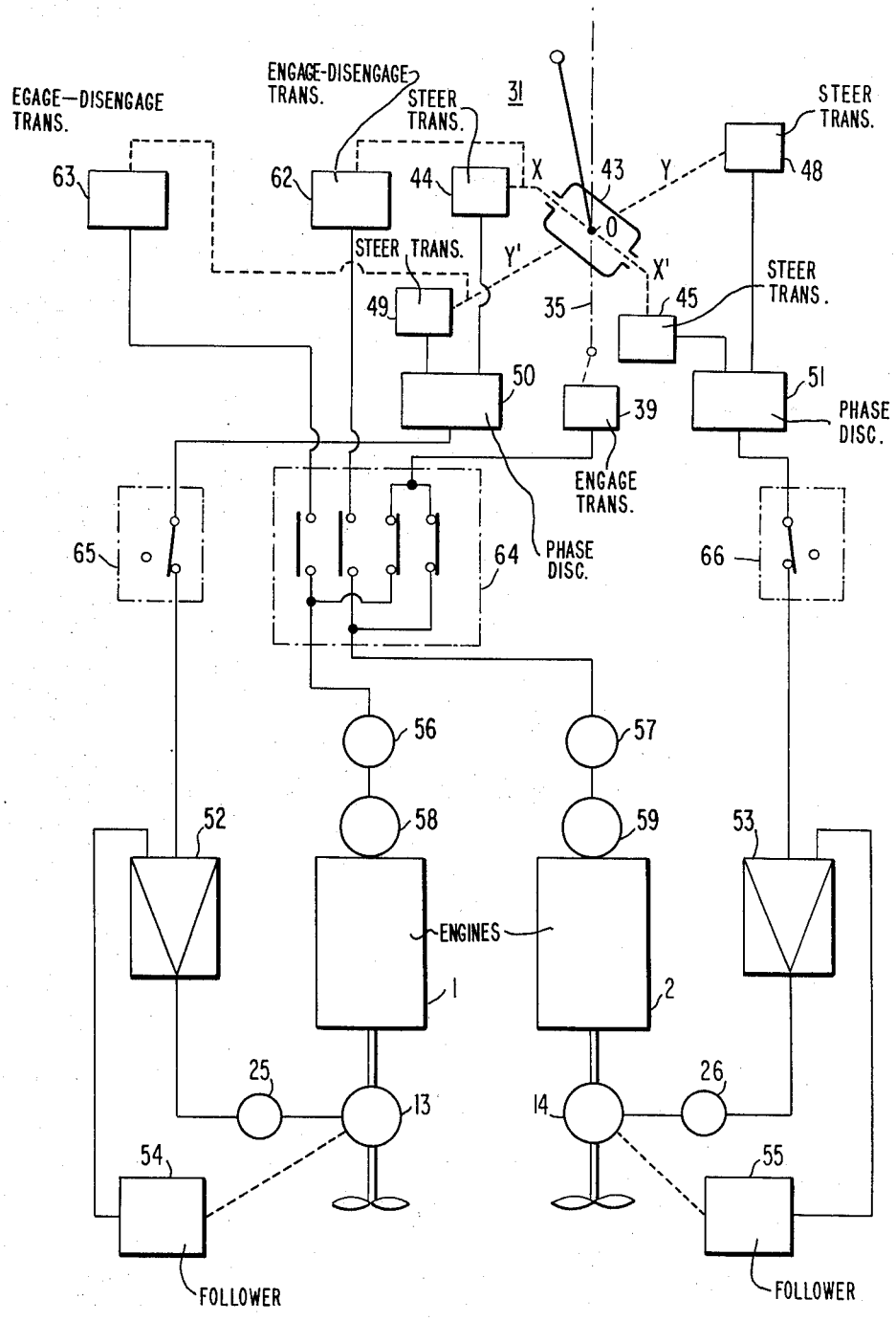
FIG. 6 is an illustration for explaining the system of the ship maneuvering apparatus according to the invention.

Referring now to FIG. 6 which shows the control system of the invention, the transmitters 44·49, 45·48 each of which comprises a differential synchro motor or a differential gear are respectively connected to phase discriminators. The phase discriminators 50, 51 are connected to the means 25, 26 for changing the direction of the propellers, through the medium of servo amplifiers 52, 53.

The directions or orientations of the propellers 13, 14 are followed by the followers 54, 55 so that the propellers are fixed when the angles of rotation thereof coincide with the orders from the handle 31, since the signals issued from the followers are fed back to the servo amplifiers 52, 53.

The speed and the clutch engaging and disengaging transmitter 39 is divided into two halves each of which is connected to respective speed regulators 56, 57 and to speed setting means 58, 59 such as governers, and then to respective engines 1, 2.

In operation, referring to FIG. 5, when the handle 31 is tilted from the neutral position *n* to any position, the ahead-astern switching transmitters 44, 45 on the axis X—X′ are rotated by component $\beta$ to issue ahead-astern switching signals, while the steering transmitters 48, 49 on the axis Y—Y′ are rotated by the component $\alpha$ to issue steering signals.

For information, the handle 31 can be set at a desired position through a desired route within the circular frame 60 of radius R or within the quadrilateral frame 61 having edges of 2R in length.

As the handle is pulled or depressed in the longitudinal direction thereof, the supporting arm 38 is rotated through the medium of the wire 35, so that the signals for controlling speed and for engaging and disengaging clutch are issued from the transmitter 39 to both engines 1, 2.

Upon receipt of signals from ahead-astern switching transmitters 44, 45, two propellers 13, 14 are swung in the opposite directions through the same angle, while the signals from steering switches 48, 49 make the two propellers swing in the same direction by the same angle.

The signals from port transmitters 44, 49 and from starboard transmitters 45, 48 in accordance with the position of the handle 31, are delivered to respective phase discriminaters 50, 51 which respectively totalize ahead-astern signal and steering signal for each of the port and starboard sides. The totalized signals are then delivered to the servo amplifiers 52, 53 as indicative of the swinging of the propellers, by which the means 25, 26 for changing directions of the propeller are actuated. The swinging of the propellers 13, 14 is followed by the followers 54, 55, so that the swinging is stopped when the propellers 13, 14 come to the positions which corresponds to the order of the handle 31.

At the same time, signals from the speed and clutch engaging and disengaging transmitter 39 is fed to speed regulators 56, 57 thereby actuating speed setting means 58, 59 to vary the speed of both engines by the same amount.

The transmitter 39 is initially set to operate at the minimum speed operation of the engines 1, 2 so that the clutch may be engaged and disengaged when the engines are operated at their minimum speeds.

The means for engaging and disengaging the clutch may be constituted by employing a micro switch or linking means at the transmitter 39, and employing an electromagnetic valve or mechanical switching valve as the actuating means for engaging and disengaging.

As will be seen from the foregoing description, by handling the handle 31, various patterns of control can be effected in combination or solely, so that all required patterns of ship maneuvering, such as ahead and astern switching, port and starboard steering, full ahead or full astern, dead-slow operation, neutral or transversing, can be effected by only one handle.

Figure 7:
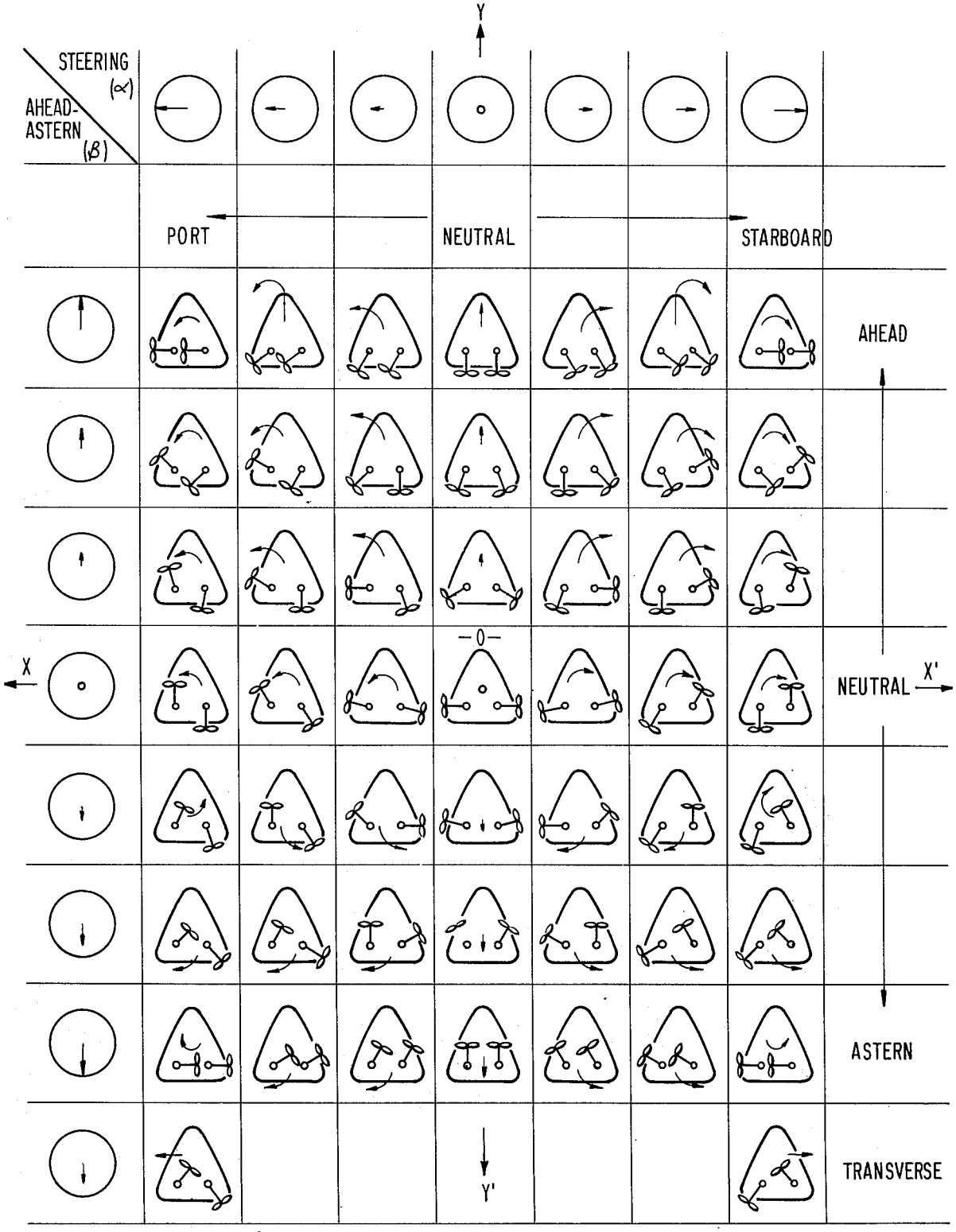
FIG. 7 shows the relationship between the direction of the propeller and the direction in which the ship moves.

Referring to FIG. 7, assuming that the component $\alpha$, which is to be converted to the steering signal to represent port steering, neutral or starboard steering, is in the horizontal direction, while the component $\beta$ representative of going ahead neutral or going astern is in vertical direction, various controls as shown are available.

In the foregoing description two engines 1, 2 are controlled synchronously. However, it is possible to control the speeds of the engines irrespective of each other, as will be described hereinafter with reference to FIG. 6.

To this end, the speed and clutch engaging and disengaging transmitter 62 for one of port and starboard sides is provided on the axis X—X′, while the other 63 is provided on the axis Y—Y′.

These transmitters 62, 63 may be directly connected to the aforementioned transmitters 44·45 and 48·49 or may be connected in shunt through the medium of gears.

The transmitters 62, 63 are connected to aforementioned speed regulators 56, 57 through the change over switch 64, and switches 65, 66 are provided between the discriminators 50, 51 and the servo amplifiers 52, 53.

When it is desired to operate engines separately, the switch 64 is thrown to separately controlling transmitters 62, 63 the switches 65, 66 are opened. Under this condition, the speeds of the engines are separately controlled in accordance with the tilting angle of the handle 31. Since the feed back means are still alive for maintaining the orientation of the handles in accordance with the order from the steering transmitters, in spite of the switching at the switches 64, 65, 66, the thrusts of the propellers are separately controlled with their directions kept constant.

If there were any difference between the thrusts of both propellers, the ship is not maneuvered in the manner as shown in FIG. 7. In other words, even if the direction of the propellers are set at certain angles as in FIG. 7, it is still possible to control the direction of the ship to a certain extent.

In addition, the grip 34 of the handle 31 can be rotated within the control rod 33, other functions may be added by utilizing the rotation of the grip 34.

As described above, the present invention provides an apparatus for maneuvering ships in which port and starboard steering, going ahead and astern, and transversing can be effected by tilting one maneuvering handle, and the speed of the engines, as well as engaging and disengaging of the clutch can be effected by moving the handle forth and back.

These controls can be effected solely, as well as in combination.

While the invention has been described in detail and with reference to specific embodiments thereof, it will be apparent to one skilled in the art that various changes and modifications can be made therein without departing from the spirit and scope thereof.

What is claimed is:

1. In an apparatus for maneuvering a ship having left and right Z type propellers, including a maneuvering handle set on a bridge of the ship, a first transmitting means having transmitters for said left and right propellers, each of said transmitters being responsive to said handle for providing a signal to switch between going ahead and astern, a second transmitting means having second transmitters for said left and right propellers, each of said second transmitters being responsive to said handle for providing a signal to steer the ship, means connected through servo amplifiers to phase discriminators for changing the direction of said left and right propellers respectively, followers connected to said servo amplifiers for discontinuing the horizontal turning of said propellers when the turning angle reaches a predetermined angle in said apparatus, and means for providing speed control and clutch engaging and disengaging signals, the improvement comprising; said handle adapted to be inclined at any angle and in any direction about the center of said handle, said first transmitting means adapted to issue a control signal so as to revolve said propellers equally in the opposite direction in accordance with the travel distance of said handle with respect to one of two cross axes through the center of said handle, said second transmitting means adapted to issue a control signal so as to revolve said propellers equally in the same direction in accordance with the travel distance of said handle with respect to another of the two cross axes, said maneuvering handle comprising a control rod having lower end forked and bent at right angle to provide two arms; a quadrilateral frame having two opposing sides respectively carrying transmitters adapted to be actuated by said arms, and another two opposing sides respectively carrying second arms for actuating second transmitters; and a shell carrying said second transmitters.

2. In an apparatus for maneuvering a ship having left and right Z type propellers, including a maneuvering handle set on a bridge of the ship, a first transmitting means having transmitters for said left and right propellers, each of said transmitters being responsive to said handle for providing a signal to switch between going ahead and astern, a second transmitting means having second transmitters for said left and right propellers, each of said second transmitters being responsive to said handle for providing a signal to steer the ship, means connected through servo amplifiers to phase discriminators for changing the direction of said left and right propellers respectively, followers connected to said servo amplifiers for discontinuing the horizontal turning of said propellers when the turning angle reaches a predetermined angle in said apparatus and means for providing speed control and clutch engaging and disengaging signals, the improvement comprising: said handle adapted to be inclined at any angle and in any direction about the center of said handle, said first transmitting means adapted to issue a control signal so as to revolve said propellers equally in the opposite direction in accordance with the travel distance of said handle with respect to one of two cross axes through the center of said handle, said second transmitting means adapted to issue a control signal so as to revolve said propellers equally in the same direction in accordance with the travel distance of said handle with respect to another of the two cross axes, said maneuvering handle comprises a grip portion to which a wire is connected, said wire passing through sleeve portion of the handle and through a control rod to be connected to an end of a supporting arm, whereby said engine speed and clutch engaging and disengaging transmitter can be controlled by said maneuvering handle.

3. In an apparatus for maneuvering a ship having left and right Z type propellers, including a maneuvering handle set on a bridge of the ship, a first transmitting means having transmitters for said left and right propellers, each of said transmitters being responsive to said handle for providing a signal to switch between going ahead and astern, a second transmitting means having second transmitters for said left and right propellers, each of said second transmitters being responsive to said handle for providing a signal to steer the ship, means connected through servo amplifiers to phase discriminators for changing the direction of said left and right propellers respectively, followers connected to said servo amplifiers for discontinuing the horizontal turning of said propellers when the turning angle reaches a desired angle in said apparatus and means for providing speed control and clutch engaging and disengaging signals, the improvement comprising: said handle adapted to be inclined at any angle and in any direction about the center of said handle, said first transmitting means adapted to issue a control signal so as to revolve said propellers equally in the opposite direction in accordance with the travel distance of said handle with respect to one of two cross axes through the center of said handle, said second transmitting means adapted to issue a control signal so as to revolve said propellers equally in the same direction in accordance with the travel distance of said handle with respect to another of the two cross axes, a pair of propeller revolution speed control transmitters interlocked with one of the ahead-astern switching transmitters and one of the steering control transmitters respectively, and a switch is provided between the respective speed regulators and said propeller revolution speed control transmitters and other switches are provided between said phase discriminators and said servo amplifiers respectively to change the control signal from said one of the ahead-astern control signals and said one of the steering control signals to said each propeller's revolution speed control signals to as to control respective propeller's revolution speed at will.

4. In an apparatus for maneuvering a ship having left and right Z type propellers, including a maneuvering handle set on a bridge of the ship, a first transmitting means having first transmitters for said left and right propellers, each of said first transmitters being responsive to said handle for providing a signal to switch between going ahead and astern, a second transmitting means having second transmitters for said left and right propellers, each of said second transmitters being responsive to said handle for providing a signal to steer the ship, means connected through servo amplifiers to phase discriminators for changing the direction of said left and right propellers respectively, followers connected to said servo amplifiers for discontinuing the horizontal turning of said propellers when the turning angle reaches a predetermined angle and means for providing speed control signal and clutch engaging and disengaging signals, the improvement comprising: said phase discriminators connected to said first and said second transmitting means for totalizing said ahead and astern signal and said steering signal, said ahead and astern signal being provided from the first transmitting means, said first transmitting means being adapted to provide a control signal so as to turn said propellers in a horizontal plane equally in the opposite direction in accordance with the travel distance of said handle with respect to one of two cross axes through the center of said handle, said steering signal being provided from the second transmitting means, said second transmitting means being adapted to provide a control signal so as to turn said propellers in a horizontal plane equally in the same direction in accordance with the travel distance of said handle with respect to the other of the two cross axes, said handle adapted to be inclined at any angle and in any direction about the center of said handle wherein said propellers are capable of rotation through 360° in a horizontal plane in response to the inclination angle of said handle.

5. An apparatus as claimed in claim 4, wherein said maneuvering handle comprises two semi-circular driving bodies having at each end transmitters and elongated slots formed therein, and a control rod having a bulbous root portion received by a bearing and having upper portions passing through the crossing point of said slots.

* * * * *